US008316498B2

(12) United States Patent
Miani

(10) Patent No.: US 8,316,498 B2
(45) Date of Patent: Nov. 27, 2012

(54) DUSTING EQUIPMENT

(75) Inventor: Massimo Miani, Savignano sul Panaro (IT)

(73) Assignee: Oracle S.R.L., Gambellara (VI) (IT)

( * ) Notice: Subject to any disclaimer, the term of this patent is extended or adjusted under 35 U.S.C. 154(b) by 0 days.

(21) Appl. No.: 13/390,425

(22) PCT Filed: Aug. 13, 2010

(86) PCT No.: PCT/IB2010/053666

§ 371 (c)(1),
(2), (4) Date: Feb. 14, 2012

(87) PCT Pub. No.: WO2011/021136

PCT Pub. Date: Feb. 24, 2011

(65) Prior Publication Data

US 2012/0137455 A1 Jun. 7, 2012

(30) Foreign Application Priority Data

Aug. 21, 2009 (IT) ..... VR2009A0126

(51) Int. Cl.
*B08B 1/04* (2006.01)

(52) U.S. Cl. ..... 15/88.3; 15/77; 15/308

(58) Field of Classification Search ..... 15/88.3; *B08B 1/02, 1/04, 5/04*
See application file for complete search history.

(56) References Cited

U.S. PATENT DOCUMENTS

| | | | | |
|---|---|---|---|---|
| 1,387,884 | A | 8/1921 | Cross | |
| 2008/0028551 | A1 * | 2/2008 | Katsuura et al. | 15/88.3 |

FOREIGN PATENT DOCUMENTS

| | | |
|---|---|---|
| DE | 19962312 | 11/1968 |
| DE | 2750822 | 5/1979 |
| DE | 7739498 | 10/1979 |
| EP | 1407835 | 5/1985 |
| EP | 1736251 | 12/2006 |
| JP | 2271590 | 11/1990 |
| WO | 85/03246 | 8/1985 |

OTHER PUBLICATIONS

PCT International Search Report mailed on Oct. 29, 2010 and issued for PCT/IB2010/053666 filed Aug. 13, 2010 in the name of Orcale S.R.L.

PCT Written Opinion mailed on Oct. 29, 2010 and issued for PCT/IB2010/053666 filed Aug. 13, 2010 in the name of Orcale S.R.L.

* cited by examiner

*Primary Examiner* — Monica Carter
*Assistant Examiner* — Stephanie N Berry
(74) *Attorney, Agent, or Firm* — Steinfl & Bruno LLP

(57) ABSTRACT

A dusting equipment (1) for dusting a substantially parallelepiped-shaped or prism-shaped item (9), in particular a book. The equipment comprises a dusting station (6), a carriage (4) and motive means (44, 51, 55) adapted to move the carriage (4) with a reciprocating motion along a moving path between a first position for receiving the item (9) and a second end-of-stroke position. The carriage (4) is adapted to move the item (9) through the dusting station (6) during a motion between the first receiving position and the second end-of-stroke position, and vice versa.

20 Claims, 13 Drawing Sheets

DUSTING EQUIPMENT

CROSS REFERENCE TO RELATED APPLICATIONS

The present application is the US national stage of International Application PCT/IB2010/053666 filed on Aug. 13, 2010 which, in turn, claims priority to Italian Patent Application VR2009A000126 filed on Aug. 21, 2009.

The present disclosure generally refers to the field of item cleaning and to equipments and methods for carrying out said cleaning.

In particular, the present disclosure refers to a dusting equipment for dusting a substantially parallelepiped-shaped or prism-shaped item; in the specific case the item is a book, a notebook, a booklet, a folder, or the like. Therefore, hereinafter reference will be made to an equipment for dusting a book; this, however, is not to be understood in a limitative manner, as what is described in the present disclosure may be applied also to other substantially parallelepiped-shaped or prism-shaped items in general.

The problem of dusting books and the like is known; said books and the like, when placed for a lengthy time on shelves in libraries, bookshops, houses or offices, are covered by dust gradually gathering thereon. Disposal of gathered dust is required in order to prevent the latter, and pathogens carried thereby, from inducing damaging and deterioration processes of books, and specifically of paper; dust disposal is also required to ensure a healthy and clean environment to persons visiting the premises in which such books are placed and coming into contact with the books themselves.

Besides book cleaning systems by manual dusting, the state of the art also comprises mechanical book-dusting equipments, like, e.g., the equipment described in European Patent EP 1 407 835 B1.

Such equipments generally comprise a roller and/or belt conveyor system carrying a book horizontally along a cleaning path, between an inlet opening in the equipment and an outlet opening placed on an opposite side of the equipment. In some of these equipments, at least two pairs of brushes rotating on parallel axes are arranged in sequence along the cleaning path and, during the motion of rotation, they pass on respective surfaces of the book, dusting them; moreover, systems are provided for adapting the distance between said parallel brushes according to the size of the book to be cleaned.

A drawback related to such prior art equipments is linked to their complexity, e.g. owing to:

- the need of motive systems, both for the conveyor and the brushes;
- the need to provide the adaptability of the distance between parallel brushes in order to conform to the book size;
- the presence of a conveyor system that must be suitable for all book types, preventing jamming or ineffective dragging, and that moreover, in some cases, has to make the book perform a 90-degree rotation.

Such complexity unavoidably affects equipment cost, maintenance needs and power consumption; because of this, until now such equipments have hardly found application in a household context or in small offices.

Another drawback related to prior art equipments is linked to their remarkable encumbrance. In fact, prior art equipments must have a certain length, owing to the need of providing a cleaning path going from one end of the equipment to the other end and along which the brushes are arranged in sequence; moreover, such equipments must have a relevant width and height, owing to the need of providing a pair of brushes with a variable distance therebetween; this imposes a sizing calculated on the maximum possible size of a book, increased by the sizes of two brushes.

Also because of this, such equipments hardly find application in a household context or in small offices.

As a further drawback related to prior art equipments, in some instances a reduced dusting effectiveness has been found in case of very dirty and/or rather light-weight books. In fact, the single passage of each face of the book near a respective brush, and at a relative velocity between book and brush that is preset by the conveyor system, may not be sufficient to ensure an effective dusting when the book is very dirty. Moreover, a light-weight book, under the action of the brush, tends to move away from the brush itself, which at that point does not adequately carry out the dusting function.

Other examples of prior art equipments are described in German Patent application DE 27 50 822, German Utility Model DE 77 39 498 and International Patent application WO 85/03246; the same considerations outlined above in connection with the drawbacks of prior art equipments substantially go for these examples as well.

Therefore, the present disclosure stems from the technical problem of providing a dusting equipment for dusting a substantially parallelepiped-shaped or prism-shaped item, allowing to obviate at least one of the drawbacks mentioned above with reference to the prior art and/or allowing to attain further advantages.

This is obtained by providing a dusting equipment, for dusting a substantially parallelepiped-shaped or prism-shaped item, according to independent claim 1.

Secondary features of the subject of the present disclosure are set forth in the corresponding dependent claims.

The subject of the present disclosure provides some relevant advantages.

A first advantage lies in the fact that, thanks to the reciprocating motion of the carriage (i.e., a reciprocating motion providing a path going from the first position to the second position, and a path returning from the second position to the first position) in the dusting station, the user (e.g., a librarian or a cleaning operator) can make the item/book perform a plurality of passages through the dusting station and therefore carry out a repeated dusting, thereby improving cleaning effectiveness in case of very dusty and/or dirty books.

Another advantage lies in the fact that the reciprocating motion of the carriage allows to reduce the length of the moving path with respect to the prior art; hence, a more compact equipment, i.e. of a more limited size, which can find application even in houses or in small offices, can be manufactured.

In one embodiment, the carriage in the first receiving position is at a height greater than a height of the carriage in the second end-of-stroke position. Said height is understood to be measured with respect to a bearing plane for the equipment, when the latter is in a normal condition of use.

This is advantageous, since gravity force facilitates motion of the carriage, and therefore of the book, between the first and the second position, reducing power required from the carriage motive system. Moreover the carriage can support the book by exploiting gravity force, e.g. by merely providing a support shelf in the lower part of the carriage, onto which shelf the book rests.

In one embodiment, the dusting station comprises at least one brush which is placed between the first receiving position and the second end-of-stroke position, so that the book interacts therewith during carriage motion.

In particular, in the first receiving position the carriage is at a height greater than a height of the brush.

In one embodiment the brush is arranged, at least partially, below the moving path. In other words the brush lies below the book, at least in part and at the dusting station, so that the book is pushed toward the brush by gravity force. This allows to simply obtain contact between brush and book, eliminating or reducing the need of movable brush-positioning systems or of systems for exerting a pressure on the book.

In one embodiment, the equipment comprises a mouth for allowing the positioning of the book on the carriage in the first receiving position and for allowing the collection of the book from the carriage in the same first receiving position. Basically, the user inserts the book in the equipment through the mouth, thereby positioning the book on the carriage in the first receiving position, and extracts it from the same mouth at the end of the cleaning operation. This is advantageous since, unlike the prior art equipments in which the book enters and exits at points spatially far therebetween, it allows the user to carry out the entire cleaning operation with no need to continuously move from one side of the equipment to the other side, or with no need to be helped by a colleague.

In one particular embodiment, the mouth is arranged in a top region of the equipment. This allows the mouth to be made closer to the elevation of the user's hands, allowing him/her a more comfortable working position.

Moreover, a moving path mainly developing with a top-bottom orientation allows to provide an equipment with a limited encumbrance in a plan and a main development in height; thus, the encumbrance problems associated with prior art equipments are reduced.

In one embodiment, the moving path is not parallel to the bearing plane, but rather it is tilted with respect to the latter; in other words, the moving path is set on a plane which is tilted with respect to the bearing plane. This allows, among other things, to attain the advantage reported above in connection with the limited encumbrance in a plan. Preferably, the moving path is not perpendicular to the bearing plane; thus, the brush lies below the moving path and therefore the book is pushed toward the brush by gravity force.

In one embodiment, the carriage is associated with return means returning it to the first receiving position; thus, when unloaded, the carriage is already in the first position and is ready to receive a new book to be cleaned.

In one particular embodiment, the return means comprises a counterweight. The weight of the counterweight may be selected so as to counterbalance the empty weight of the carriage, increased by the average weight of a medium-sized book; thus, during a dusting operation the carriage+book+counterweight system is approximately balanced and therefore the force and power required during dusting for moving the carriage and book along the moving path are reduced.

In one embodiment, a handle is associated with the carriage for manually moving of the carriage along the moving path. Therefore, the carriage is directly moved by the user, with no need of a specially provided electric motor and related drive; moreover, the user has full control over the number of dusting passages to be carried out and the carriage speed. Hence, besides constructive simplicity, an operating dusting mode, that the user can easily adapt to specific needs, is obtained.

In one embodiment, the carriage comprises pressing means adapted to keep the book in pressing contact against the brush, i.e. to push the book toward the brush. This is particularly advantageous in case the book to be cleaned is light-weight and therefore gravity force is not sufficient to adequately push it toward the brush. In one particular embodiment, the pressing means comprises a plane plate associated with a remaining portion of the carriage by a four-bar-linkage connecting member; thus, the plane plate does not change its tilt while pressure is exerted and remains parallel to the book face onto which it pushes, thereby obtaining a uniform and well-distributed pushing on said face.

In one embodiment, the equipment comprises position-limiting means for preventing an interference between book and brush beyond a threshold value, i.e. for preventing a sinking of the book into the brush beyond a certain limit. This is provided to avoid that the book may be damaged by an excessive contact with the brush and therefore by an excessive rubbing, or to avoid that the book may be opened by the action of the brush itself. In particular, it has been observed that an optimal threshold value is of the order of 6 mm, or lower than said value.

In one particular embodiment, the position-limiting means comprises wires or cables. This is advantageous above all in order to manufacture limiting means placed partially inside the brush, e.g. intersecting the brush; in fact, it has been observed that limiting means shaped like wires or cables minimize damaging and permanent bending of the brush bristles.

In one embodiment, the brush is substantially cylinder-shaped and rotates about a respective axis of rotation which is orthogonal to the direction of motion of the carriage in the moving path. Thanks to this, the brush allows for a high cleaning effectiveness with minimal encumbrance.

In one embodiment, the dusting station comprises two brushes arranged at an angle therebetween, so as to simultaneously dust two faces of the item which form an edge therebetween. In particular, in case of a book or a parallelepiped-shaped item, the brushes are perpendicular to each other, i.e. have respective axes that are perpendicular to each other.

With respect to the prior art envisaging a plurality of pairs of parallel brushes, such a configuration of two brushes arranged at an angle allows to simplify the equipment, as no systems are required for changing the distance between parallel brushes in order to adjust to book thickness; moreover, the number of brushes is reduced. Thus, a reduction in equipment encumbrance is also attained.

By properly selecting the length of the two brushes, the equipment is manufactured so as to be employed for a broad range of book sizes, with no need of adapters or modifications. Besides this, the dusting operation takes place on two faces at a time and allows the cleaning of the entire book with just three steps, each related to two respective edge-forming faces.

In one embodiment, the tilt of the moving path and the arrangement of the two brushes are such that, at the dusting station, the book is pushed toward each of the two brushes by gravity force, attaining the aforementioned respective advantages.

In general, the subject of the present disclosure can allow to manufacture a dusting equipment that be simpler, less bulky, less expensive, more light-weight, more effective, and/or of easier use than prior art equipments; therefore, it can find a broader application than prior art equipments. Moreover, thanks to the lesser encumbrance and also to the lesser weight, the dusting equipment can easily be carried, and, e.g., it can be carried on wheels pivoted to a support framework of the equipment.

Further advantages, features and the operation steps of the subject of the present disclosure will be made evident in the following detailed description of an embodiment thereof, given by way of example and not for limitative purposes. However, it is evident how each embodiment of the subject of the present disclosure may have one or more of the advantages listed above; in any case, however, it is not required for each embodiment to concomitantly have all of the advantages listed.

It is also to be understood that all possible combinations of the aforeindicated embodiments, and of those described with reference to the following detailed description, fall within the scope of the present disclosure.

Reference will be made to the figures of the annexed drawings, wherein.

Figure 17A:
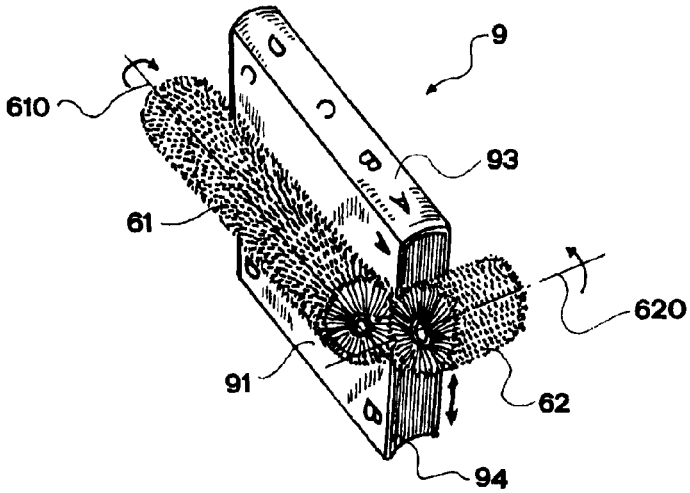
Figure 17B:
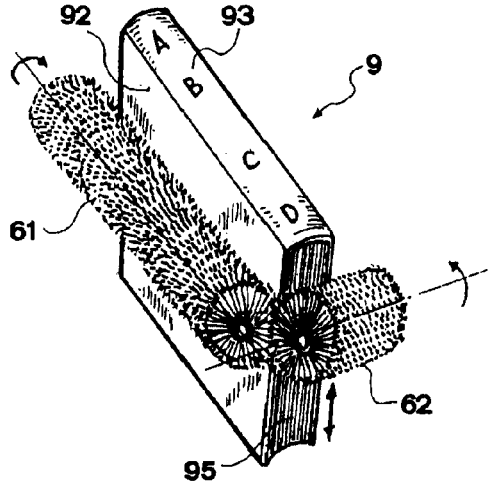
Figure 17C:
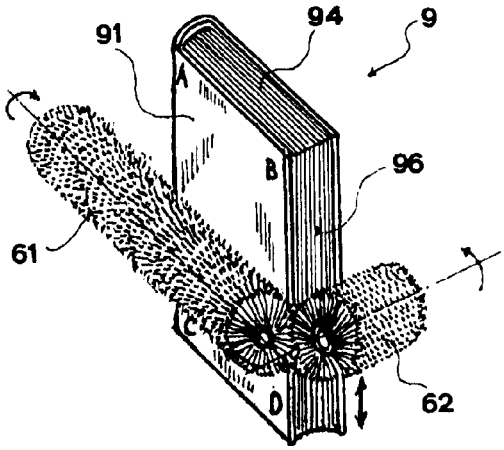

FIGS. 17A to 17C schematically show three subsequent steps of dusting a substantially parallelepiped-shaped item by a dusting equipment according to the present disclosure.

Referring initially to FIGS. 1 to 4, an embodiment, according to the present disclosure, of a dusting equipment for dusting a substantially parallelepiped-shaped or prism-shaped item is shown; the equipment is denoted by reference number 1.

In particular, said substantially parallelepiped-shaped or prism-shaped item is a book or the like, denoted by reference number 9; it is however understood that the book 9 may be replaced by another substantially parallelepiped-shaped or prism-shaped item in general.

Specifically, the dusting equipment 1 is adapted to dust items having sizes indicatively comprised, as order of magnitude, between some millimeters and some tens of centimeters.

The equipment 1 comprises a main body 11 of box-like shape, supported by a support structure or framing 12, optionally provided with wheels 13, which keeps the main body 11 at a determined height with respect to a bearing plane P for the equipment 1.

Figure 1:
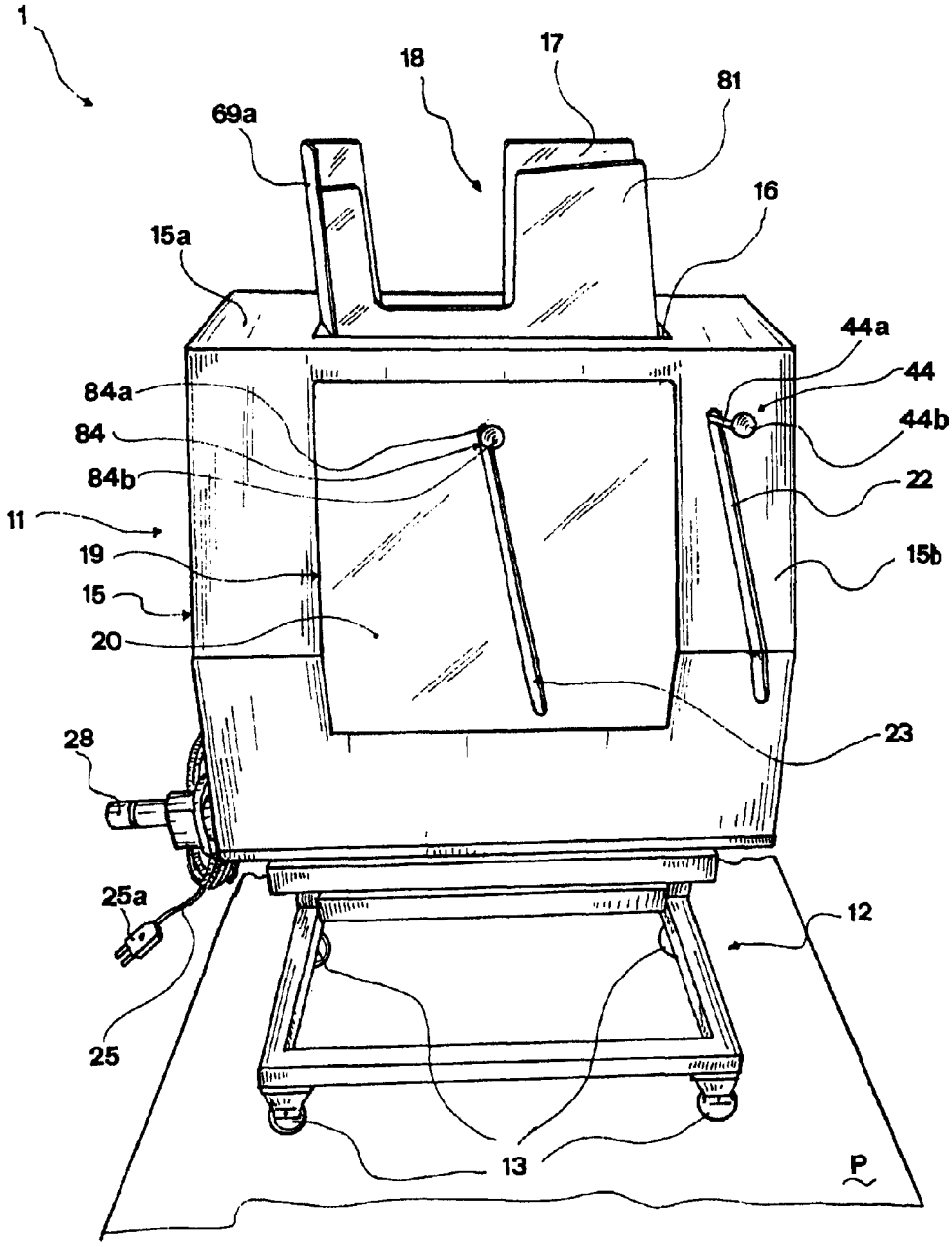
FIG. 1 shows a front perspective view of a dusting equipment according to the present disclosure.
Figure 2:
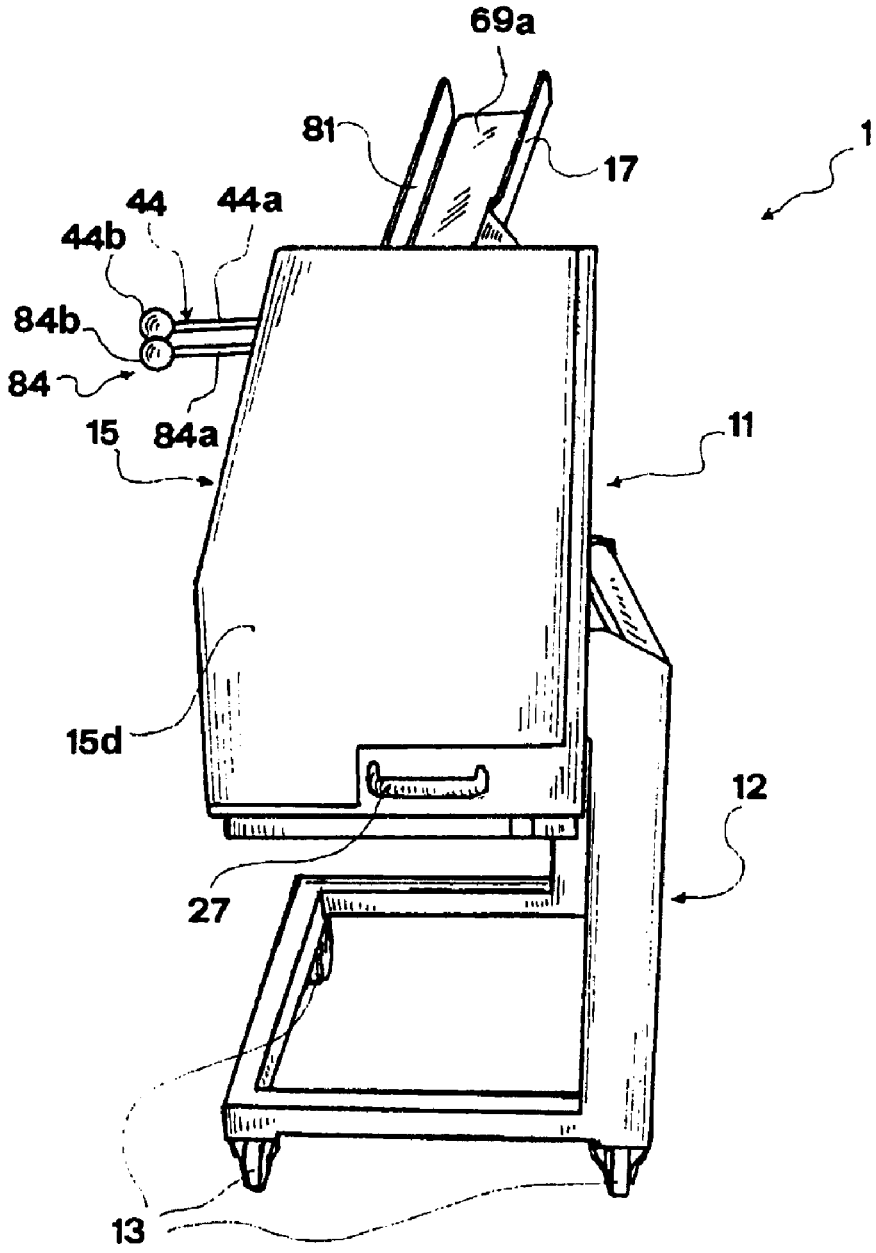
FIG. 2 shows a first side perspective view of the equipment according to FIG. 1.
Figure 3:
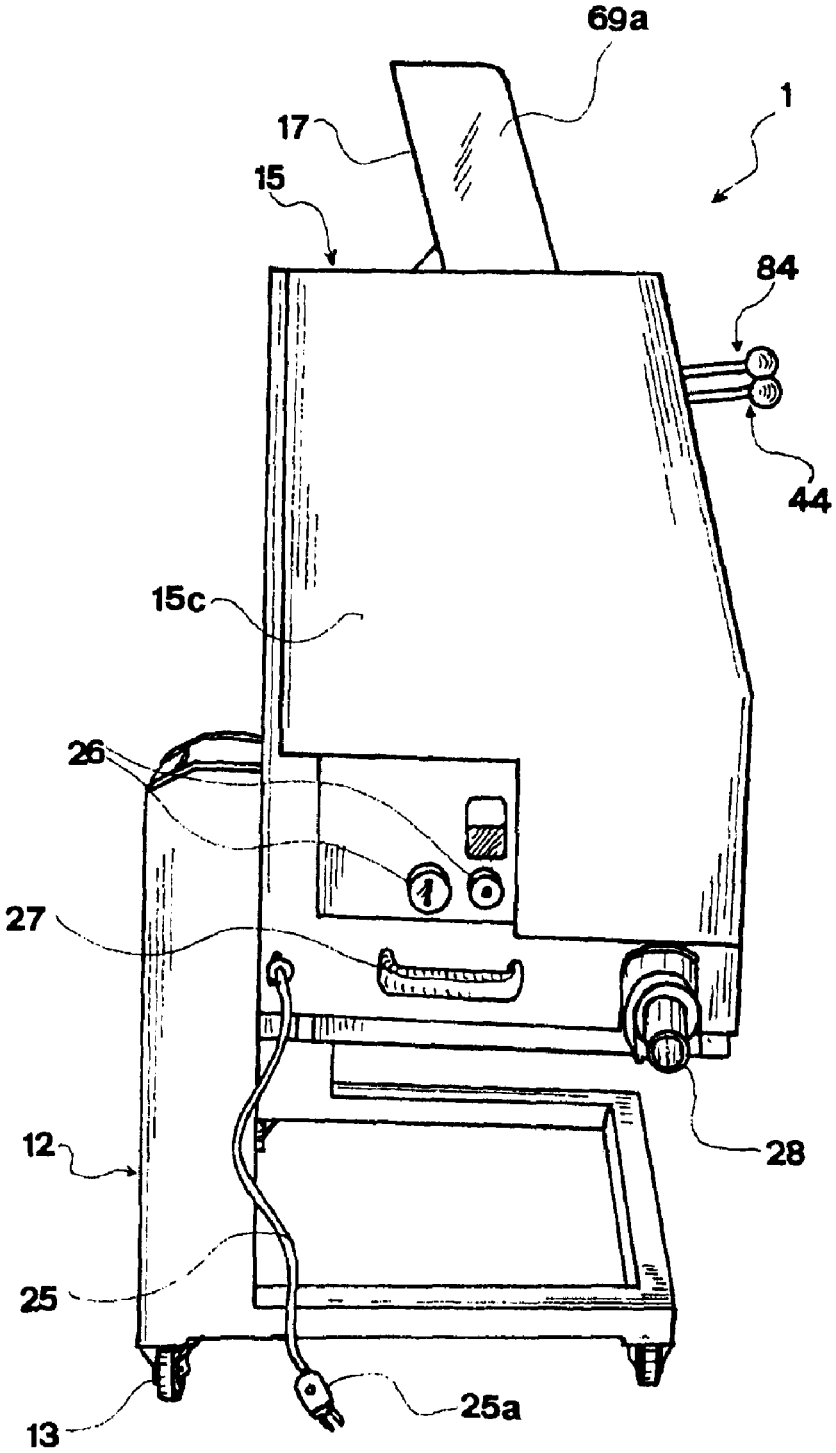
FIG. 3 shows a second side perspective view of the equipment according to FIG. 1.
Figure 4:
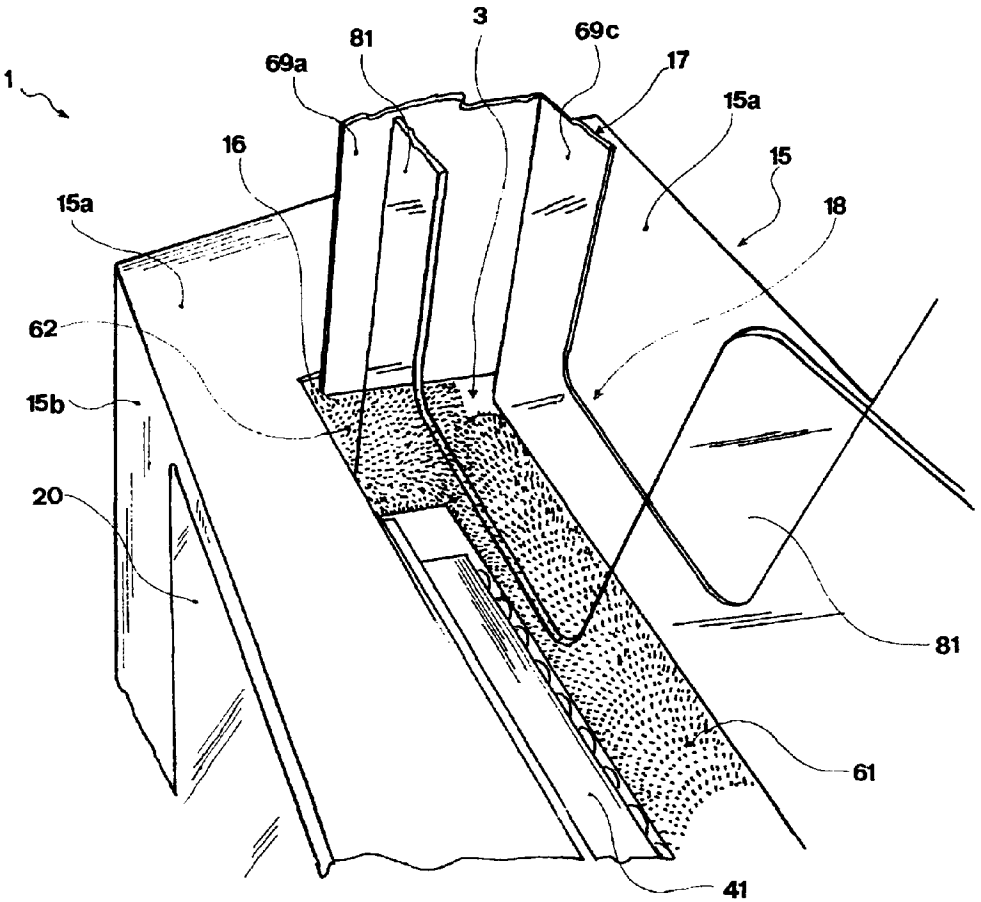
FIG. 4 shows, in a top perspective view, an enlarged detail of the equipment according to FIG. 1.

In the present disclosure, the terms "high", "low", "above", "below", "upper", "lower", "top", "bottom", "horizontal", "vertical", "side" and the like are to be understood in connection with the position and spatial orientation of the equipment 1 under conditions of normal use, like that shown in FIG. 1 in which the equipment 1 rests on the bearing plane P by said support framing 12.

The main body 11 comprises a box-shaped case 15, or carter, e.g. made of sheet metal, enclosing an internal chamber 3 in which an operation of cleaning, i.e. a dusting operation, of the book 9 takes place.

A top face 15*a* of the box-shaped case 15 has a mouth or opening 16 for inserting the book 9 into the internal chamber 3. A guide chute 17 is fixed on at least one part of the periphery of the opening 16 and extends upwards externally to the top face 15*a*. The guide chute 17 facilitates a user in inserting the book 9 into the internal chamber 3 and guides the book 9 so that the latter enters the internal chamber 3 with a correct tilt and angle with respect to a vertical direction.

The guide chute 17 has a shaping with a deep notch 18, to allow the user to easily hold the book 9 with one hand until correct positioning thereof in the internal chamber 3 is obtained.

A front face 15*b* of the box-shaped case 15 has a window 19 shielded by a sheet 20 of see-through material, e.g. glass or polymethyl methacrylate. The window 19 allows the user to see the internal chamber 3 and therefore visually check the operation of cleaning the book 9.

Moreover, in the front face 15*b* two slots 22, 23 having elongated shape are made, preferably having a top-bottom orientation and being tilted with respect to the vertical direction.

In particular, a first slot 22 is made in a side peripheral region of the front face 15*b* and allows the top-down sliding of a first handle 44 or motive lever; a second slot 23 is made in the sheet 20, in a central region of the front face 15*b*, and allows a top-bottom sliding of a second handle 84 or push lever.

In the example, each handle 44, 84 comprises a respective rod 44*a*, 84*a* extending between the internal chamber 3 and the outside, and a respective knob-shaped ending 44*b*, 84*b* external to the front face 15*b*.

The main body 11 comprises an electrical cable 25 provided with a plug 25*a* for power-supplying the equipment 1, switches 26 for turning on and/or off the equipment 1, and handgrips 27 or handles, fixed e.g. to side faces 15*c*, 15*d* of the box-shaped case 15, to facilitate the carrying of the equipment 1.

Moreover, a tubular portion 28 is provided, communicating with a vent 31 or opening made in the box-shaped case 15. The tubular portion 28, which in the example is arranged on the bottom of a side face 15*c*, is adapted to be associated with a pipe of a suction device (not shown), in order to perform suction of air and dust from the internal chamber 3.

Figure 5:
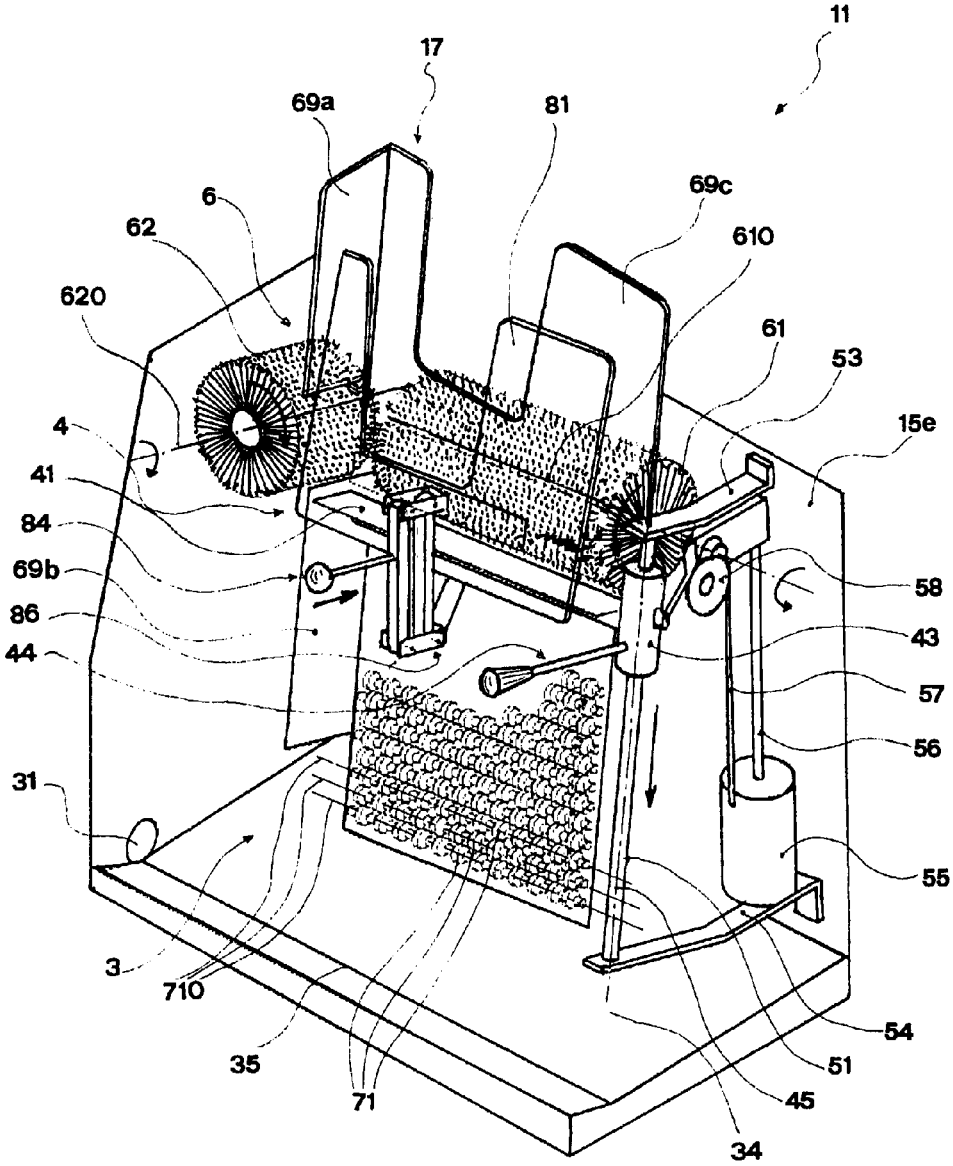
FIG. 5 shows a perspective view of the equipment according to FIG. 1, from which some parts have been removed, in a first operating position thereof.
Figure 6:
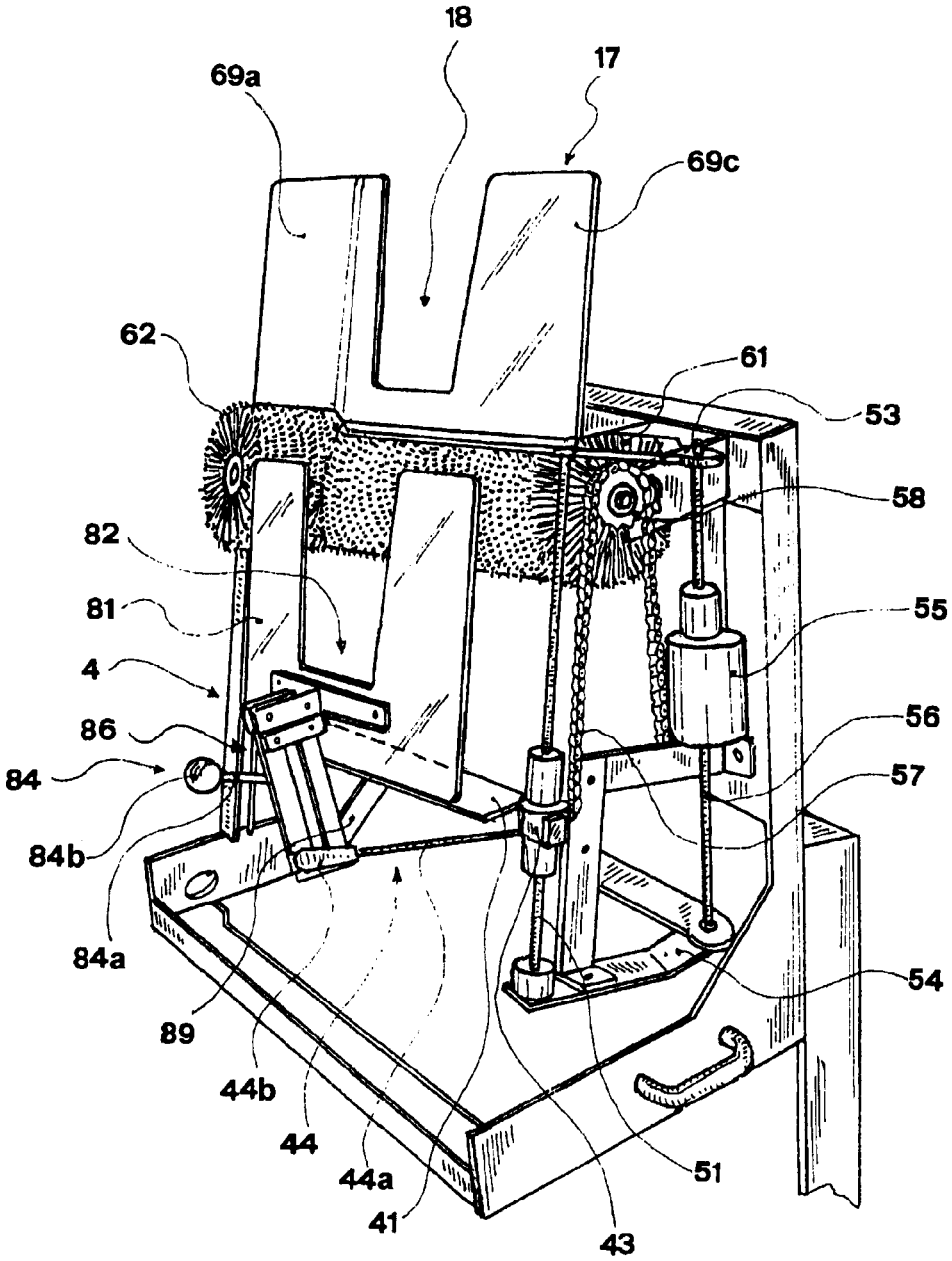
FIG. 6 shows a perspective view of the equipment according to FIG. 1, from which some parts have been removed, in a second operating position thereof.
Figure 7:
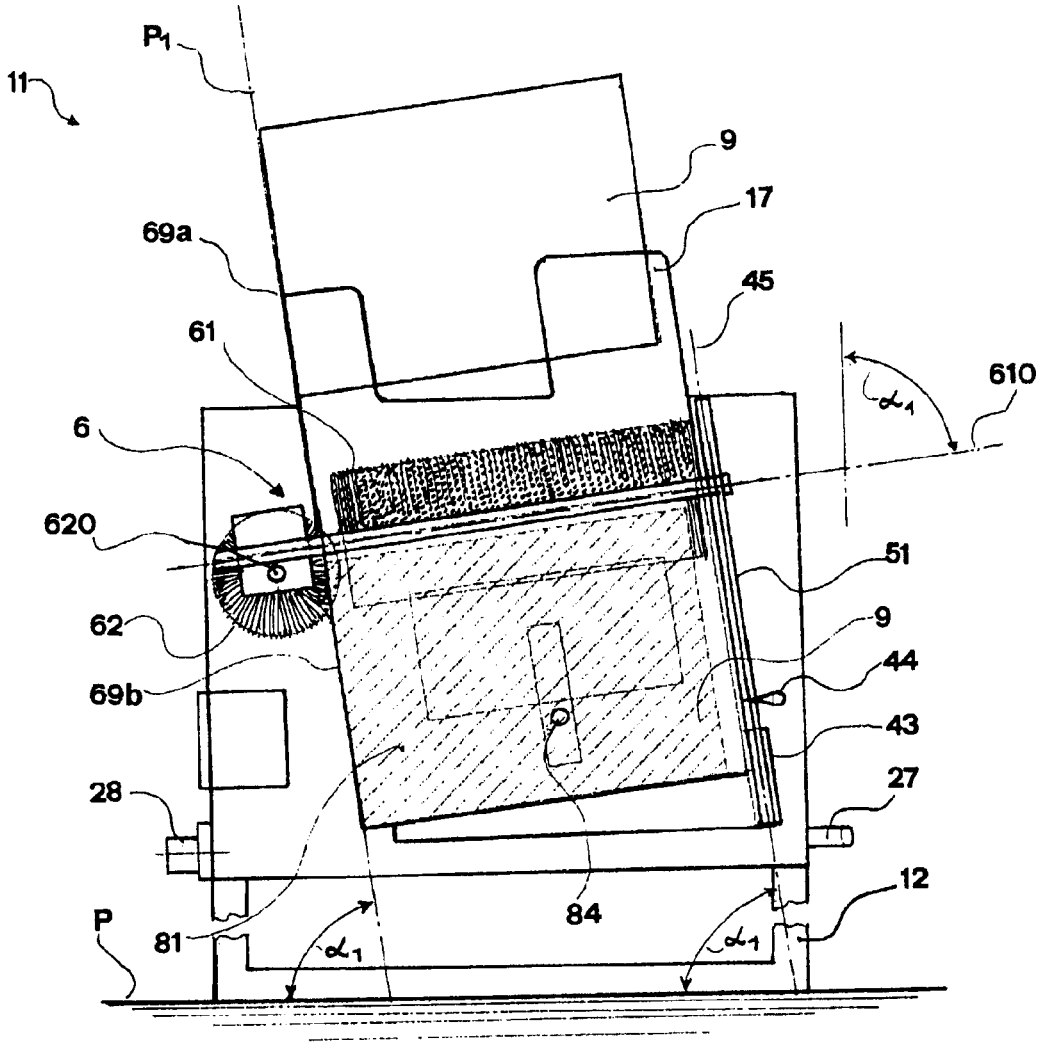
FIG. 7 shows a schematic and phantom front view of the equipment according to FIG. 1, in the second operating position.

FIGS. 5 and 6 show, in schematic views, the equipment 1 from which some parts have been removed. In particular, the support framing 12 and part of the box-shaped case 15 have been removed. Therefore, FIGS. 5 and 6 show the components inside the internal chamber 3.

In the internal chamber 3 a carriage 4 is arranged, comprising a support shelf 41 for the book 9, which shelf 41 is associated with guide means. In particular, such guide means comprises a cylindrical body 43 having a longitudinal through hole. Thanks to said longitudinal hole, the cylindrical body 43 is slidably slipped onto a guide rod 51, substantially rectilinear, extending between a top region and a bottom region of the internal chamber 3. Shelf 41 and cylindrical body 43 are fixed therebetween so as to jointly move. The guide rod 51, thanks to suitable supports 53, 54 arranged at its ends, is fixed to the load-bearing structure of the main body 11, e.g. at the rear face 15*e* of the box-shaped case 15.

The carriage 4 is therefore movable, and it is adapted to perform a guided motion between a first receiving position (FIG. 5), in which the shelf 41 is near the mouth 16, and a second end-of-stroke position (FIG. 6), in which the shelf 41 is near the bottom 34 of the internal chamber 3.

In other words, the carriage 4 is movable with a reciprocating motion along a moving path between a first position for receiving the book 9 and a second end-of-stroke position, and back. The carriage 4 in the moving path has a direction 45 of motion which is defined by the guide rod 51. The shelf 41 extends substantially orthogonal to the direction 45 of motion along the moving path.

In the first position, the shelf 41 being near the mouth 16, the carriage 4 is adapted to receive a book 9, which is inserted by a user until a lower face of the book 9 abuts on the shelf 41. At this point, the book 9 rests on the shelf 41 and therefore is supported by the carriage 4: the dusting process can begin, in the course of which the book 9 travels together with the carriage 4 along the moving path.

As shown in FIGS. 5 to 10, the carriage 4 in the first receiving position is at a height h1 from the bearing plane P which is greater than a height h2 of the carriage 4 from the bearing plane P in the second end-of-stroke position. Basically, the motion of the carriage 4 from the first position to the second position occurs from top to bottom.

Moreover, in the example the moving path has a motion direction 45 which is tilted with respect to the bearing plane P (i.e., is not parallel to the latter), and in addition it is tilted with respect to the vertical direction orthogonal to the bearing plane P. In fact, the guide rod 51 is not orthogonal to the bearing plane P (i.e., to the horizontal plane), but, on the contrary, it has a certain tilt.

Figure 9:
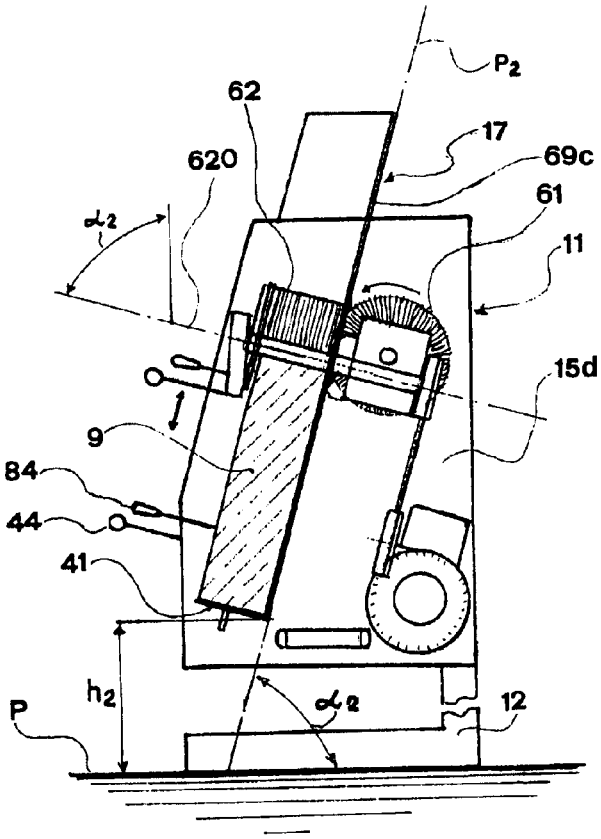
FIG. 9 shows a first schematic and phantom side view of the equipment according to FIG. 1, in the second operating position.
Figure 10:
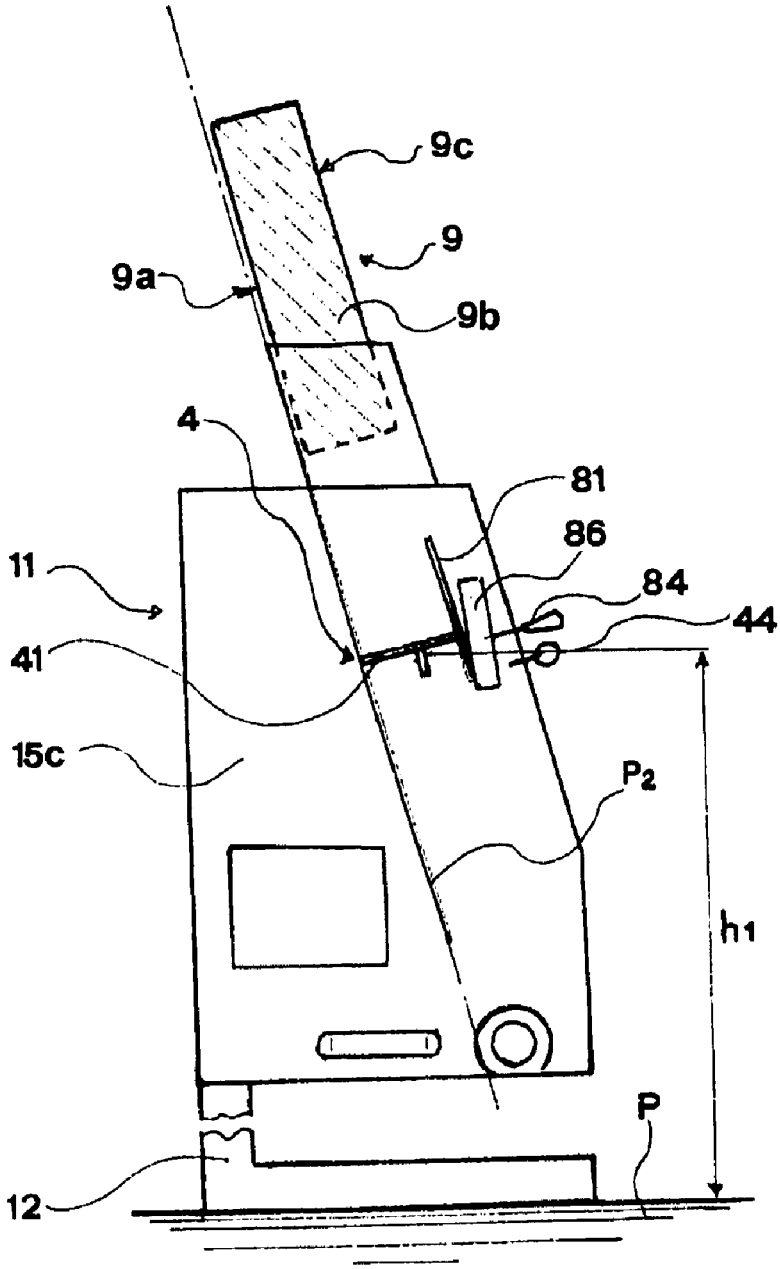
FIG. 10 shows a second schematic and phantom side view of the equipment according to FIG. 1, in the first operating position.

In the example the guide rod 51, and therefore the motion direction 45, is tilted at an angle $\alpha 1$ of 81 degrees with respect to the horizontal plane in a front view (FIG. 7) and is tilted at an angle $\alpha 2$ of 75 degrees with respect to the horizontal plane in a side view (FIG. 9). Therefore, it is tilted overall of about 73 degrees with respect to the horizontal plane, i.e. with respect to the bearing plane P.

In other words, the moving path is set on a plane tilted with respect to the bearing plane P. In the present specific example, the moving path in a front view is set on a first plane P1 tilted at an angle $\alpha 1$ of 81 degrees; in a side view, the moving path is arranged on a plane P2 tilted at an angle $\alpha 2$ of 75 degrees. The marks of such planes P1, P2 are shown respectively in FIGS. 7 and 9.

The first handle 44 projecting from the front face 15*b* through the first slot 22 is associated with the carriage 4, and in particular with the cylindrical body 43. The first handle 44 is basically a motive handle, allowing a user to manually move the carriage 4 along the moving path in the motion direction 45.

Moreover, return means is preferably provided for returning the carriage 4 to the first receiving position. Such return means comprises, in the example, a counterweight 55, slidably associated with a respective guide rod 56. The counterweight is connected to the carriage 4, and in particular to the cylindrical body 43, by a chain 57, or a cable or a belt, or analogous flexible element. The chain 57 has a first end associated with the carriage 4 and a second end associated with the counterweight 55; moreover, it is arranged astride a pulley 58, or a toothed wheel, which is pivoted to a support fixed at the main body 11.

Therefore, the motion of the carriage 4 to the second end-of-stroke position corresponds to a rising of the counterweight 55, whose weight force tends therefore to return the carriage 4 to the first receiving position. The counterweight 55 is preferably sized so that its mass be such as to approximately counterbalance the mass of the unloaded carriage 4, increased by the average mass of a medium-sized book 9.

Basically, the first handle 44, the guide rod 51 and the counterweight 55 are part of the motive means of the carriage 4, which is apt to move the carriage 4 along the moving path with said reciprocating motion.

Moreover, a dusting station 6 is arranged in the internal chamber 3; the book 9 is moved by the carriage 4 through the dusting station. The book 9 crosses the dusting station 6 during a motion of the carriage 4 between the first receiving position and the second end-of-stroke position, and vice versa (i.e., in the return stroke between the second position and the first position).

It should be noted that, within the scope of the present disclosure, "end-of-stroke" should not necessarily be understood as a position in which the carriage 4 encounters a mechanical stop which physically prevents a further motion thereof; in fact, "end-of-stroke" is also to be understood as a position at the end of the working stroke, i.e. a position beyond which the carriage 4 can move, but beyond which the book 9 is no longer crossing the dusting station 6.

The dusting station 6 comprises two brushes 61, 62 that are arranged at an angle $\beta$ therebetween, so as to simultaneously dust two respective faces 9*a*, 9*b* of the book 9, the two faces 9*a*, 9*b* forming an edge therebetween.

The brushes 61, 62 face the region of space crossed by the carriage 4 during its motion, so as to come into contact with the two faces 9*a*, 9*b* of the book 9 and thereby carry out a dusting action on the faces 9*a*, 9*b* themselves. Since the book 9 is parallelepiped-shaped, therefore with orthogonal faces, the brushes 61, 62 are arranged perpendicular to each other, such as to simultaneously dust, in the example, a cover board 9*a* and an edge face 9*b*.

The brushes 61, 62 are substantially cylinder-shaped and are adapted to rotate about a respective longitudinal axis of rotation 610, 620. In other words, each brush 61, 62 is rotatable about the respective longitudinal axis 610, 620. In particular, the bristles of the brushes 61, 62 are radially arranged with respect to said respective axis of rotation 610, 620.

The axis of rotation 610 of the first brush 61 is set at an angle $\beta$ with the axis of rotation 620 of the second brush 62; in the example, said angle $\beta$ is a right angle and the axes 610, 620 are perpendicular to each other, therefore the brushes 61, 62 are substantially perpendicular to each other.

Figure 8:
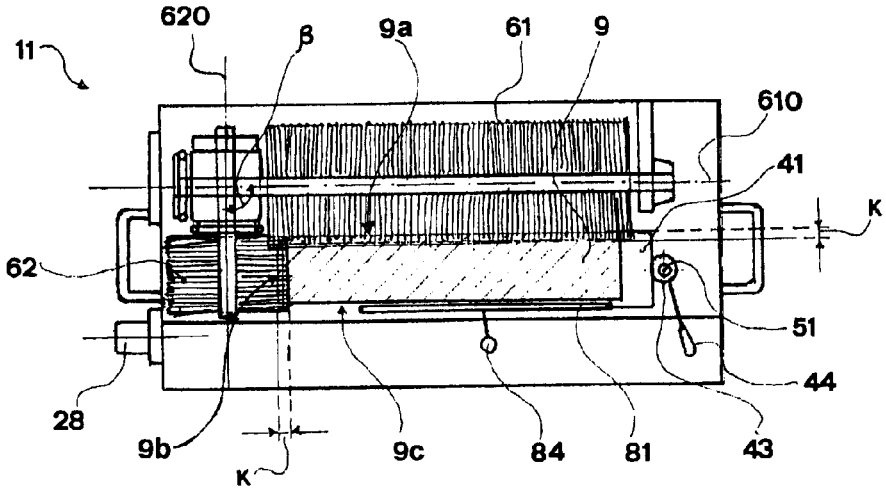
FIG. 8 shows a schematic and phantom top plan view of the equipment according to FIG. 1.

However, it should be noted that the axes of rotation 610, 620 might not be coplanar, i.e. they might be at different elevations. The axes of rotation 610, 620 forming said angle $\beta$ and/or being perpendicular is therefore to be understood in the sense that this occurs in a projection view according to the motion direction 45 (as shown in FIG. 8).

In the example, the first brush 61 has a length greater than the second brush 62 and is intended for dusting the cover boards 91, 92 of the book 9; therefore the first brush 61 is arranged substantially parallel to a long side of the mouth 16, in the example it is parallel to the front face 15*b* of the box-shaped case 15. Moreover, its axis of rotation 610 is orthogonal to the motion direction 45 of the carriage 4 along the moving path and therefore, in a front view (FIG. 7), it forms an angle $\alpha$1 with the vertical direction.

In the example, the second brush 62 has a length shorter than the first brush 61 and is intended for dusting the edge faces 94, 95, 96 of the book 9; therefore the second brush 62 is arranged substantially parallel to a short side of the mouth 16, in the example is parallel to the side face 15*c* of the box-shaped case 15. Moreover, its axis of rotation 620 is orthogonal to the motion direction 45 of the carriage 4 along the moving path and therefore, in a side view (FIG. 9), it forms an angle $\alpha$2 with the vertical direction.

In the example, the brushes 61, 62 have a diameter of 16 cm and a length of 40 cm and of 11 cm, respectively. In the example, the bristles of the brushes 61, 62 have a diameter of 0.3 mm and are made of horsehair and/or of synthetic material.

The brushes 61, 62 are preferably arranged so as to be interposed, at least partially, between the space region crossed by the carriage 4 during its motion (i.e., the moving path) and the bearing plane P. In other words, the brushes 61, 62 are at least partially below the moving path (or better, below a respective plane P1, P2 on which the moving path is set) and face said space region at its faces P1, P2 facing toward the bearing plane P.

In still other words, the brushes 61, 62 are arranged so that, at the dusting station 6, the book 9 be above them, i.e. be pushed toward the brushes 61, 62 by gravity force (or better, by a gravity force component which is orthogonal to the motion direction 45 of the carriage 4 along the moving path).

Figure 11:
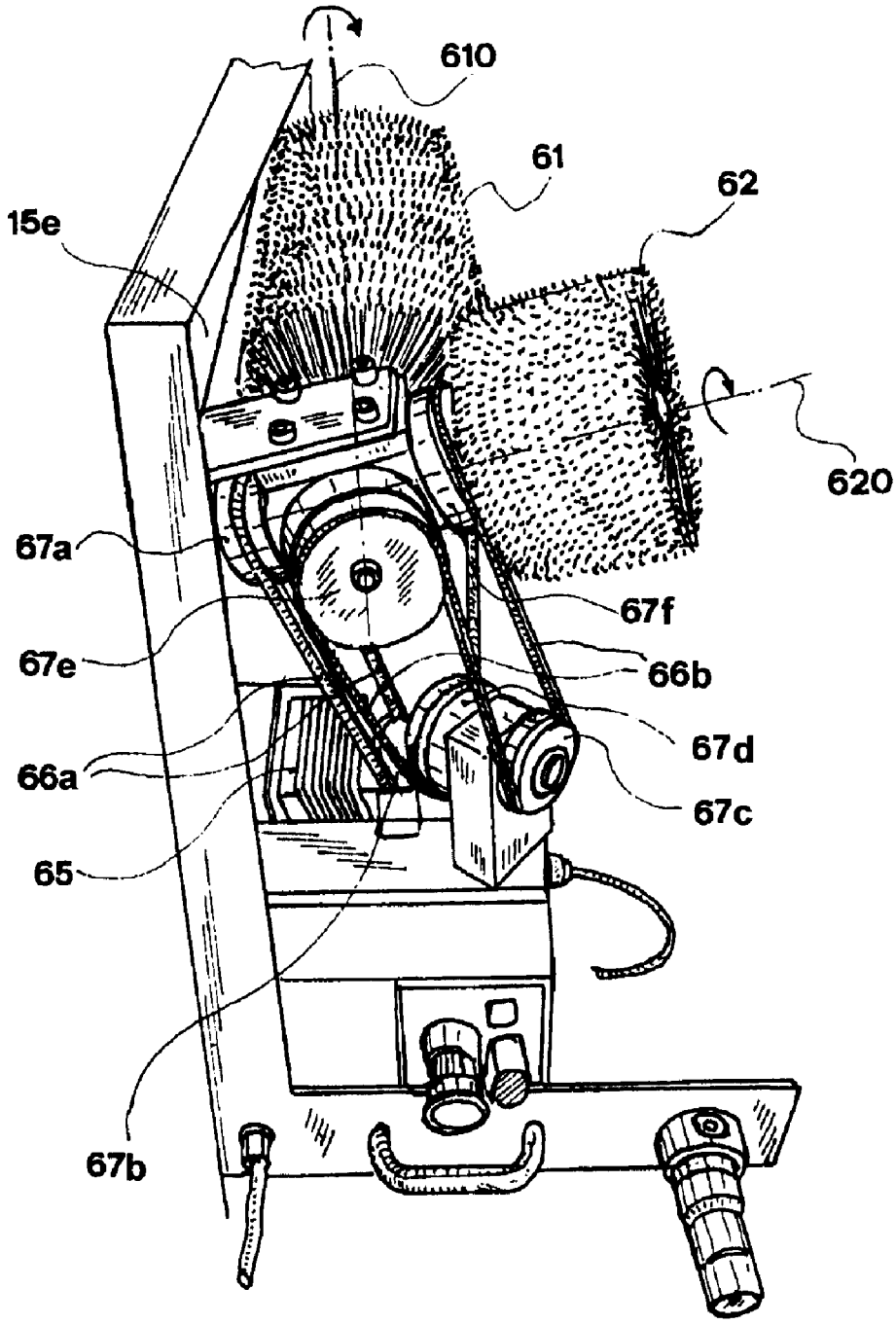
FIG. 11 shows a perspective view of an enlarged detail of the equipment according to FIG. 1, from which some parts have been removed.

The brushes 61, 62 are preferably arranged near the mouth 16 and are pivoted to the structure of the main body 11, e.g. thanks to specially provided ball bearings (not shown); they are set in rotation about the respective axes 610, 620 by a motive system schematically shown in FIG. 11.

In the example the motive system comprises an electric motor 65, power-supplied through the electrical cable 25 and controlled by switches 26, and a drive system with belts 66*a*, 66*b* and pulleys 67*a*, 67*b*, 67*c*, 67*d*, 67*e*, 67*f*. The manufacturing of such a drive system is substantially within the ability of a person skilled in the art, and therefore it will not be described further. Anyhow, other drive systems or other motive systems are possible as well.

Preferably, the brushes 61, 62 rotate at the same angular velocity, e.g. of 180 rpm, and their rotation sense is that shown in the figures; basically, the portions of brushes 61, 62 facing onto the space region crossed by the carriage 4 move in the same sense of motion of the carriage 4 from the first position to the second position, i.e. top to bottom. Position-limiting means, to prevent the book 9 from sinking into the brushes 61, 62 beyond a threshold value, is also provided. In other words, it is necessary to limit the interference K between the bristles of the brushes 61, 62 and the book 9, because an excessive length of bristle acting on the faces of the book 9 might both lead to damaging of the book 9 itself and cause excessive wear and/or rapid deterioration of the brushes 61, 62.

Figure 12:
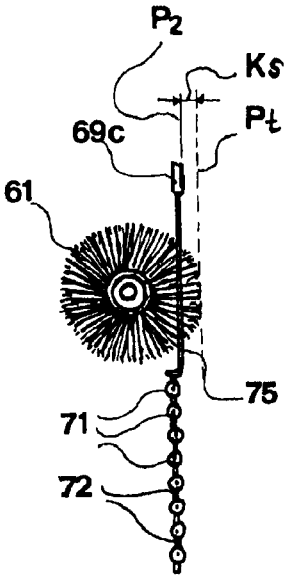
FIG. 12 shows a schematic side view of a detail of the equipment according to FIG. 1, from which some parts have been removed.
Figure 13:
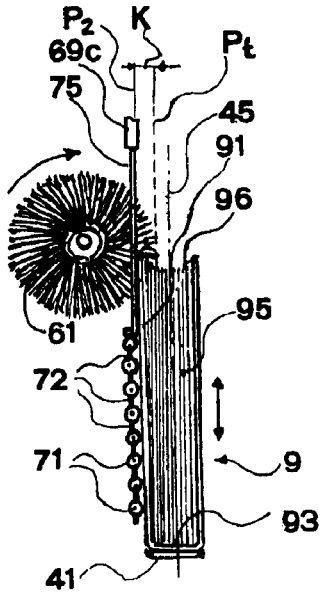
FIG. 13 shows the detail according to FIG. 12 during operation of the equipment.

Interference K is defined herein as the distance between plane Pt, tangent to the bristles of the brush 61, 62 parallelly to the motion direction 45, and plane P1, P2 on which the face of the book 9 dusted by the brush itself lies, which face is closer to the axis of rotation 610, 620 of the brush (FIGS. 12 and 13).

In the case of the second brush 62, acting on the edge face 9*b*, said limiting means comprises plane elements, like e.g. sheet metals, placed near the brush 62, before and after it. In particular, there are provided a first plane element 69*a* placed between the mouth 16 and the second brush 62, and a second plane element 69*b* placed between the second brush 62 and the bottom region 34 of the internal chamber 3. Therefore, such plane elements 69*a*, 69*b* define a plane P1 on which the edge face 9*b* of the book 9 to be dusted can slide, and they prevent the book 9 from approaching the axis of rotation 620 beyond the set limit. In the example, the first plane element 69*a* is part of the guide chute 17.

In the case of the first brush 61, acting on the cover board 9*a*, said limiting means likewise comprises a plane element 69*c* between the mouth 16 and the first brush 61, which plane element 69*c* is part of the guide chute 17. A plurality of parallel rows of small rollers 71 or wheels, e.g. having a 12-mm diameter, is instead provided between the first brush 61 and the bottom region of the internal chamber 3; the small rollers 71 are rotatably pivoted to uprights 72 so that the axes of rotation 710 of the rollers 71 be parallel to the axis of rotation 610 of the first brush 61 and orthogonal to the motion direction 45 of the carriage 4 along the moving path.

During the transit of the book 9, the cover board 9*a* thereof rests on the rollers 71 which, being free to rotate, are set in rotation and accompany the motion of the book 9 minimizing the risk of damaging the cover board 9*a*, risk that instead might occur in case of prolonged slipping against a continuous surface. Basically, a plane P2 tangent to the surface of the rollers 71 (besides to the plane element 69*c*) defines the maximum approaching of the book 9 to the axis of rotation 610 of the brush 61.

Figure 14:
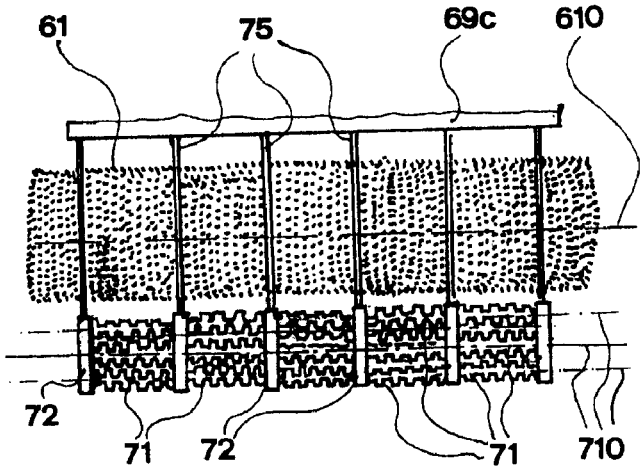
FIG. 14 shows a schematic front view of the detail according to FIG. 12.

Moreover, in the region between the plane element 69*c* and the rollers 71, i.e. just at the first brush 61, further position-limiting means is arranged, in particular wires or cables 75, which are taut, e.g., between the plane element 69*c* and the uprights 72. Such position-limiting means is arranged parallel to each other and orthogonal to the axis of rotation 610 of the first brush 61, as shown in FIG. 14. In the example, metal cables 75 having a 1-mm diameter are employed.

This is necessary because, in case of a book 9 having a flexible cover and being placed with the spine face 93 resting on the shelf 41, the first brush 61 tends to open the book 9, as the bristles of the first brush 61 hook the edge of the cover 91 at the edge face 96 and drag it in an opening direction. To prevent this phenomenon, which otherwise may lead to damaging, said cables 75 are arranged; the cables 75, even inside the first brush 61, define a limit beyond which the book 9 or parts thereof cannot go, i.e., they implement a threshold value Ks of the interference of the book 9 with the first brush 61.

In particular, an optimal threshold value Ks was verified to be of 6 mm, or optionally lower than said value.

The carriage 4 further comprises pressing means 8 adapted to keep the book 9 in pressing contact against the brushes; such pressing means 8 allow to push the book 9 toward the brushes, in particular toward the first brush 61. This becomes necessary above all in case of a rather light-weight book 9, for which gravity force is not sufficient to ensure that the book 9 remains against the brushes 61, 62 and for which, therefore, the dusting might be less effective.

Hence, the pressing means 8 may be operated by the user in case he/she finds it necessary.

In particular, the pressing means 8 comprises a plane plate 81, e.g. made of see-through material such as glass or polymethyl methacrylate, which is associated with the remaining portion of the carriage 4 by a joint adapted to allow its motion. The plane plate 81 is arranged parallel to the first brush 61 and is in a spaced apart relationship therefrom, so that an interspace for receiving the book 9 is defined, and it extends from the shelf 41 toward the mouth 16. In particular, when the carriage 4 is in the first position for receiving, the plane plate 81 projects from the mouth 16 and, together with the guide chute 17, defines a housing for the inserting of the book 9.

The plane plate 81 has it also a shaping with a deep notch 82, which is analogous to the notch 18 of the guide chute 17 and carries out the same function of facilitating the user in holding the book 9.

The plane plate 81 is substantially perpendicular to the shelf 41 and is parallel to the motion direction 45; therefore, the plane plate 81 is parallel to the respective cover board 9*c* of the book 9 and, when the pressing means 8 is operated, it is capable of exerting an action of pressure and uniform pushing on the cover board 9*c* itself. Moreover, thanks to the friction onsetting between the plane plate 81 and the cover board 9*c*, a light-weight book 9 is also prevented from being displaced away from the second brush 62.

The plane plate 81 is displaced toward the first brush 61 thanks to said second handle 84, projecting from the front face 15*b* through the second slot 23. The second handle 84 is basically a push lever, allowing a user, by pushing thereon, to push the plane plate 81 and therefore the book 9 toward the first brush 61.

In the example, in order to cause the plane plate 81 to perform a motion of translation remaining substantially perpendicular to the shelf 41 and parallel to the motion direction 45, the plane plate 81 is associated with the remaining portion of the carriage 4 through of a four-bar-linkage or pantograph-shaped connecting member 86.

In particular, a first upper side 86*a* of the four-bar linkage 86 is rigidly fixed to the plane plate 81 by a bracket 86*g*, whereas a second lower side 86*b*, opposite to the first upper side 86*a*, is fixed to an arm 89 extending from the shelf 41. Thus, since the two sides 86*a* and 86*b* remain always parallel, the tilt of the plane plate 81 with respect to the shelf 41 does not change during operation of the pressing means 8. Between the other parallel sides of the four-bar linkage 86, i.e. between the third side 86*c* and the fourth side 86*d*, a spring 87 is arranged. The second handle 84 is e.g. associated with said third side 86*c* of the four-bar linkage 86.

Figure 15:
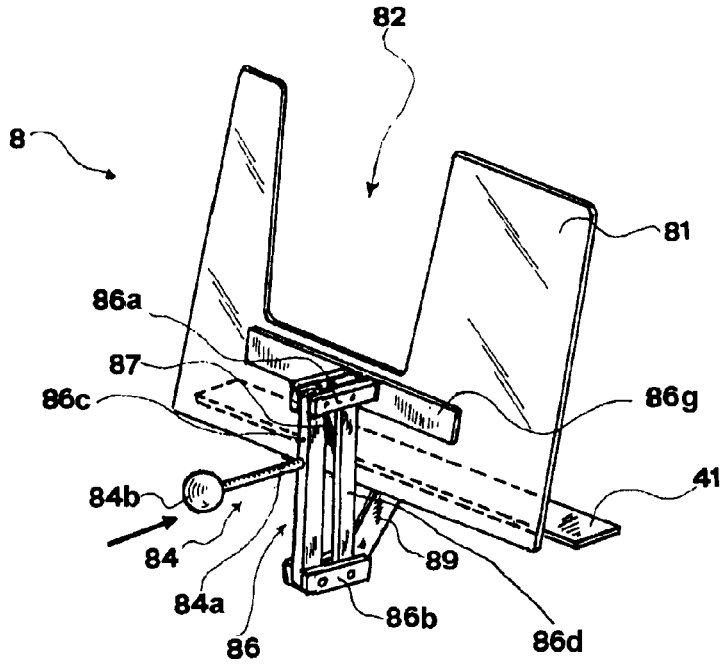
FIG. 15 shows a perspective view of an enlarged detail of the equipment according to FIG. 1, from which some parts have been removed, in a first condition thereof.

The spring 87 is subjected to lengthening, and therefore to tensioning, when the plane plate 81 is pushed closer to the first brush 61. In other words, the spring 87 in resting condition (FIG. 15) keeps the plane plate 81 at the maximum possible distance from the first brush 61, so that the interspace available for the book 9 be maximum and therefore also the thickness admissible for the book 9 be maximum.

If the book 9 is heavy, gravity force is sufficient to push it against the brushes 61, 62 and therefore there is no need to use the pressing means 8.

Figure 16:
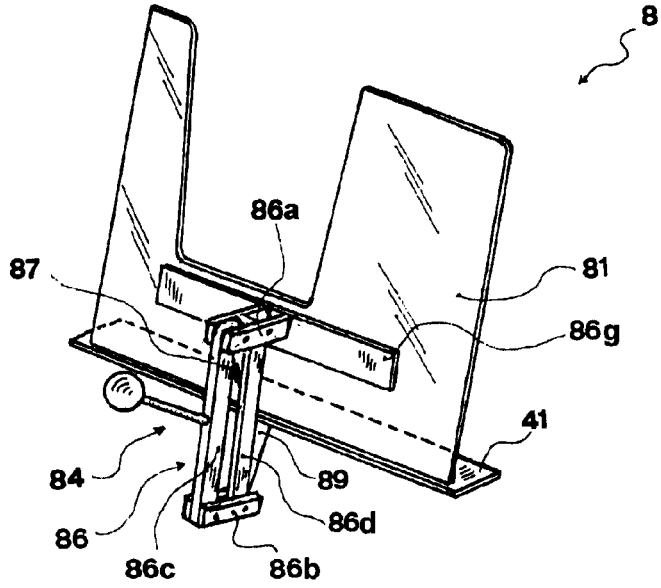
FIG. 16 shows a perspective view of the detail according to FIG. 15, in a second condition thereof.

If the book 9 is light-weight, the user pushes the second handle 84, causing the plane plate 81 to abut against the cover board 9*c* of the book 9 and pressing the other cover board 9*a* against the first brush 61; the spring 87 is set in a tensioned condition (FIG. 16). The user keeps the pressure on the second handle 84 until the end of the cleaning operation.

At the end of the operation the user releases the second handle 84; the spring 87 returns the plane plate 81 in the initial condition, i.e. away from the first brush 61 and the book 9, facilitating a collection of the book 9 and already setting itself in position for a new operation.

Hereinafter, the operation steps of the dusting equipment 1 will be described.

The carriage 4, thanks to the action of the counterweight 55, is initially in the first receiving position, i.e. near the mouth 16.

The user connects a suction device to the tubular portion 28 and activates both the suction device and the electric motor 65 by the switches 26, setting the brushes 61, 62 in rotation about their respective axes 610, 620.

The user inserts a book 9, or other item to be dusted, through the mouth 16, until a bottom-facing face of the book 9 (e.g. the side edge face 96, or the spine face 93) abuts on the shelf 41 of the carriage 4; thus, the positioning of the book 9 on the carriage 4 is carried out. In the example shown in FIG. 17A, the book 9 is inserted so that the first cover board 91 be facing the first brush 61 and the upper edge face 94 be facing the second brush 62; these faces are dusted and cleaned in the first step described hereinafter.

If the book 9 is heavy, its very weight opposes the counterweight 55 and causes the carriage 4 to move to the second end-of-stroke position; otherwise, the user slides the first handle 44 in the first slot 22, bringing it downward together with the carriage 4 to which it is fixed.

During this motion, carriage 4 and book 9 cross the dusting station 6, in which the brushes 61, 62 come into contact with the two faces 91, 94 of the book 9 and dust them.

At this point, the user shifts the first handle 44 upward, returning the carriage 4 to the first position. The dusting station 6 is again crossed by the book 9, therefore with a further dusting passage. In case the book 9 is particularly dirty, the user can repeat several times the motion of the carriage 4 between the first position and the second position, and vice versa, so as to implement further passages of the book 9 through the dusting station 6.

Dust removed from the book 9 gathers on the bottom 34 of the internal chamber 3, thanks to gravity force and to the direction of rotation of the brushes 61, 62, which push dust downward. The bottom 34 of the internal chamber 3 has surfaces tilted toward a depression or collecting channel 35, on a side of which said vent 31 connected to the tubular portion 28 is made. This fosters dust gathering at the depression 35 and its removal through the vent 31 thanks to the suction device. When the dusting of the two faces 91, 94 has ended, the user returns the carriage 4 in the first receiving position and collects the book 9 from the carriage 4, again through the mouth 16.

In the second step (FIG. 17B), the book 9 is inserted again, rotated by 180 degrees with respect to the first step, through the mouth 16 so that the second cover board 92 be facing the first brush 61 and the lower edge face 94 be facing the second brush 62; these faces 92, 94 are dusted and cleaned in the second step, which goes on analogously to the above-described first step.

In the third step (FIG. 17C), the book 9 is inserted again, rotated by 90 degrees with respect to the first step, through the mouth 16, so that the first cover board 91 (or alternatively the second cover board 92) be facing the first brush 61 and the side edge face 96 be facing the second brush 62; these faces 91, 96 are dusted and cleaned in the third step, which goes on analogously to the above-described first step. In particular, the first cover board 91 is further dusted with respect to the dusting during the first step.

At the end of the third step, the book 9 is collected from the carriage 4 and the cleaning operation has ended.

Dusting of spine face 93 is not customarily carried out, because the latter might be damaged by brush action (e.g., identification labels bearing bibliographical references could come off) and anyhow it is a part usually requiring much less frequent cleaning with respect to the other faces of the book 9. Anyhow, should also a dusting of the spine face 93 be necessary, it might be carried out in a fourth step in which the book 9 is inserted rotated by 180 degrees with respect to the third phase, so that the spine face 93 be facing the second brush 62 and the second cover board 92 be facing the first brush 61.

As mentioned hereto, if the book 9 is light-weight, the user pushes the second handle 84 during the afore-described steps, to press the plane plate 81 against the book 9 and the latter against the first brush 61. In this case the user moves the carriage 4 along the moving path, holding the first handle 44 with one hand and the second handle 84 with the other hand.

The subject of the present disclosure has been hereto described with reference to preferred embodiments thereof. It is understood that other embodiments might exist, all falling within the concept of the same invention, and all comprised within the protective scope of the claims hereinafter.

The invention claimed is:

1. A dusting equipment for dusting a substantially parallelepiped-shaped or prism-shaped item, the dusting equipment comprising:

a dusting station;

a carriage moveable along a moving path between a first position and a second position, the first position being a position to receive the item and a second position being an end-of-stroke position; and a motive device configured to move the carriage in a reciprocating motion along the moving path, wherein the carriage is configured to move the item through the dusting station during a motion between the first position and the second position, and vice versa, wherein the carriage in the first position is at a first height greater than a second height of the carriage in the second position with respect to a bearing plane for the equipment and wherein the moving path is set on a plane tilted with respect to the bearing plane.

2. The equipment according to claim 1, further comprising a return system for returning the carriage to the first position.

3. The equipment according to claim 2, wherein the return system comprises a counterweight.

4. The equipment according to claim 1, further comprising, a mouth for allowing a positioning of the item on the carriage in the first position, and for allowing a collection of the item from the carriage in the first position, wherein the mouth is arranged in a top region of the equipment.

5. A dusting equipment for dusting a substantially parallelepiped-shaped or prism-shaped item, the dusting equipment comprising:

a dusting station;

a carriage moveable along a moving path between a first position and a second position, the first position being a position to receive the item and a second position being an end-of-stroke position; and a motive device configured to move the carriage in a reciprocating motion along the moving path, wherein the carriage is configured to move the item through the dusting station during a motion between the first position and the second position, and vice versa, wherein the motive device comprises a handle associated with the carriage for manually moving the carriage along the moving path.

6. The equipment according to claim 5, comprising a mouth for allowing a positioning of the item on the carriage in the first position, and for allowing a collection of the item from the carriage in the first position.

7. The equipment according to claim 5, wherein the item is a book.

8. The equipment according to claim 5, further comprising a return system for returning the carriage to the first position.

9. A dusting equipment for dusting a substantially parallelepiped-shaped or prism-shaped item, the dusting equipment comprising:

a dusting station;

a carriage moveable along a moving path between a first position and a second position, the first position being a position to receive the item and a second position being an end-of-stroke position; and a motive device configured to move the carriage in a reciprocating motion along the moving path, wherein the carriage is configured to move the item through the dusting station during a motion between the first position and the second position, and vice versa, wherein the dusting station comprises at least one brush and the carriage comprises a pressing device configured to keep the item in pressing contact against said at least one brush and wherein the pressing device comprises a plane plate associated with a remaining portion of the carriage by a four-bar-linkage connecting member.

10. The equipment according to claim 9, further comprising a position limiter for preventing an interference of the item with said at least one brush beyond a threshold value.

11. The equipment according to claim 10, wherein the position limiter comprises wires or cables.

12. A dusting equipment for dusting a substantially parallelepiped-shaped or prism-shaped item, the dusting equipment comprising:

a dusting station;

a carriage moveable along a moving path between a first position and a second position, the first position being a position to receive the item and a second position being an end-of-stroke position; and a motive device configured to move the carriage in a reciprocating motion along the moving path, wherein the carriage is configured to move the item through the dusting station during a motion between the first position and the second position, and vice versa, wherein the dusting station comprises at least one brush, said at least one brush arranged at least partially below the moving path, the arrangement of said at least one brush configured to cause, at the dusting station, the item to be pushed toward said at least one brush by force of gravity.

13. The equipment according to claim 12, further comprising a position limiter for preventing an interference of the item with said at least one brush beyond a threshold value.

14. The equipment according to claim 13, wherein the position limiter comprises wires or cables.

15. The equipment according to claim 12, wherein the carriage in the first position is at a first height greater than a second height of the carriage in the second position with respect to a bearing plane for the equipment, and wherein the moving path is set on a plane tilted with respect to the bearing plane.

16. A dusting equipment for dusting a substantially parallelepiped-shaped or prism-shaped item, the dusting equipment comprising:

a dusting station;

a carriage moveable along a moving path between a first position and a second position, the first position being a position to receive the item and a second position being an end-of-stroke position; and a motive device configured to move the carriage in a reciprocating motion along the moving path, wherein the carriage is configured to move the item through the dusting station during a motion between the first position and the second position, and vice versa, wherein the dusting station comprises two brushes arranged at an angle therebetween, as the two brushes being configured to simultaneously dust two faces of the item which form an edge therebetween.

17. The equipment according to claim 16, wherein the two brushes are substantially cylinder-shaped and are rotatable about a respective axis of rotation, the axis of rotation of a first brush forming said angle with the axis of rotation of a second brush.

18. The equipment according to claim 16, wherein the two brushes have axes substantially perpendicular to each other, said angle being a right angle.

19. The equipment according to claim 16, wherein each of the two brushes is arranged at least partially below the moving path, the arrangement of the two brushes being configured to cause, at the dusting station, the item to be pushed toward each of the two brushes by force of gravity.

20. The equipment according to claim 16, wherein the item is a book.

* * * * *